US011278118B2

(12) United States Patent
Clark et al.

(10) Patent No.: US 11,278,118 B2
(45) Date of Patent: Mar. 22, 2022

(54) SUPPORT COMPONENT FOR A STORAGE SYSTEM

(71) Applicant: SUPPLY POINT SYSTEMS LIMITED, Rugby (GB)

(72) Inventors: Iain Clark, Rugby (GB); Rafael Veiga, Rugby (GB)

(73) Assignee: Supply Point Systems Limited

( * ) Notice: Subject to any disclaimer, the term of this patent is extended or adjusted under 35 U.S.C. 154(b) by 0 days.

(21) Appl. No.: 16/964,042

(22) PCT Filed: Jan. 22, 2019

(86) PCT No.: PCT/GB2019/050168
§ 371 (c)(1),
(2) Date: Jul. 22, 2020

(87) PCT Pub. No.: WO2019/145696
PCT Pub. Date: Aug. 1, 2019

(65) Prior Publication Data

US 2021/0037975 A1 Feb. 11, 2021

(30) Foreign Application Priority Data

Jan. 23, 2018 (GB) ..... 1801044

(51) Int. Cl.
*A47B 95/00* (2006.01)
*A47B 88/407* (2017.01)
*A47B 88/427* (2017.01)
*A47B 88/423* (2017.01)

(52) U.S. Cl.
CPC ..... *A47B 95/008* (2013.01); *A47B 88/407* (2017.01); *A47B 88/423* (2017.01); *A47B 88/427* (2017.01)

(58) Field of Classification Search
CPC ... A47B 88/407; A47B 88/423; A47B 88/427; A47B 88/43; A47B 2088/4278; A47B 47/0091
See application file for complete search history.

(56) References Cited

U.S. PATENT DOCUMENTS 2,212,191 A * 8/1940 Dietz ..... A47B 88/487 312/334.18
3,744,869 A * 7/1973 Anderson ..... A47B 88/427 312/348.1
3,771,849 A * 11/1973 Barber ..... A47B 88/43 312/350
4,440,461 A * 4/1984 Powell ..... A47B 88/417 312/334.8

(Continued)

FOREIGN PATENT DOCUMENTS

DE 7505122 U 9/1976

OTHER PUBLICATIONS

Great Britain Search Report for Great Britain Application No. GB1801044.7, dated Jul. 23, 2018, 3 pages.

(Continued)

*Primary Examiner* — Daniel J Rohrhoff
(74) *Attorney, Agent, or Firm* — RatnerPrestia

(57) ABSTRACT

A support component for a storage cabinet includes an elongate bar; and a resilient leg formed in the upper surface of the bar and extending between two opposite sides of the bar. The resilient leg includes an engagement protrusion.

9 Claims, 7 Drawing Sheets

(56) References Cited

U.S. PATENT DOCUMENTS

| | | | | | |
|---|---|---|---|---|---|
| 5,775,786 | A * | 7/1998 | Liebertz | A47B 88/43 | 312/257.1 |
| 5,980,007 | A * | 11/1999 | Singh | A47B 88/427 | 248/222.11 |
| 6,042,206 | A * | 3/2000 | Bowyer | A47B 88/43 | 312/330.1 |
| 6,273,534 | B1 * | 8/2001 | Bueley | A47B 46/005 | 211/187 |
| 7,722,139 | B1 * | 5/2010 | Chen | A47B 88/427 | 312/334.7 |

OTHER PUBLICATIONS

International Search Report and Written Opinion for International Application PCT/GB2019/050168, dated Apr. 16, 2019, 8 pages.

* cited by examiner

SUPPORT COMPONENT FOR A STORAGE SYSTEM

CROSS REFERENCE TO RELATED APPLICATIONS

This is a U.S. National Phase application of PCT/GB2019/050168, filed Jan. 22, 2019, which claims priority to Great Britain Patent Application No. 1801044.7, filed Jan. 23, 2018, the disclosures of each of these applications being incorporated herein by reference in their entireties for all purposes.

FIELD OF THE INVENTION

The present invention relates to a support component for storage units. Specifically, it relates to a support component for supporting drawers in stock control systems well-known for use, for example in manufacturing and medical facilities or as vending machines.

BACKGROUND OF THE INVENTION

In typical automated stock control systems, a storage cabinet comprises a plurality of latched drawers held between panels fixed between support beams. Articles to be supplied to users are provided in the drawers or compartments of the drawers. Examples of such articles include cutting tools and the like used with machine tools; other manufacturing tools and components; drugs, needles and other medical items; and legal documents. A control system allows a user to access the required article by unlatching the drawer containing the required article. The drawer is then pulled out from the home position (where no compartments are exposed) to the extent that the compartment containing the article is exposed, when the drawer is latched again to prevent further opening of the drawer.

In a known system, each panel includes two different types of supports for the drawers. A guide block is provided on one side and a support is provided on the other side such that each drawer is supported by a guide block mounted on one panel and a support mounted on an adjacent panel. As the cabinet is configured to hold drawers of different sizes, large-sized guide blocks and supports are needed to support a large drawer. Moreover, as the distance between the support and the adjoining end of the large drawer is greater than that for a standard drawer, the same support is unable to provide enough support to the large drawer. Therefore, two different sizes of supports are required to ensure stability of the drawer. However, using two different sizes of support needs additional stock and it also makes assembling more time consuming. Moreover, in the existing cabinet, the support is screwed to the side of the panel. This not only increases the cost of manufacturing but also the time needed to assemble and/or reconfigure the cabinet.

Therefore, there exists a need for a simpler and more cost-effective support that can support different sized drawers and helps to reduce the cost and assembly time for the cabinet.

SUMMARY OF THE INVENTION

The present invention has been made to address the problems of the prior art system. According to an aspect of the present invention, there is provided a support component comprising an elongate bar; and a resilient leg formed in the upper surface of the bar and extending between two opposite sides of the bar, wherein the resilient leg comprises an engagement protrusion.

Such a support component, when used on a panel in a storage system, can be easily attached and/or removed from the panel due to the resilience and flexibility offered by the resilient leg. The engagement protrusion aids in fixing the support component to the panel without the need of any screws or other fastening means. It saves time and effort in assembling a storage system which requires attaching several such support components to support a plurality of drawers. Moreover, the storage system can be re-configured by easily removing a support component from one point and fixing it at some other point on the system.

Preferably, the elongate bar comprises at least one protruding peg extending outwards from the lower surface of the bar.

Preferably, the protruding peg is formed at one end of the bar.

Preferably, the protruding peg is formed part way along the length of the bar and adjacent the resilient leg.

According to another aspect of the invention, there is provided a storage cabinet comprising at least one storage unit adapted to be held between panels mounted onto support beams; and the support component as described above, wherein the support component is adapted to be fixed to a side of at least one of the panels such that the storage unit is at least partially supported on the support component.

Preferably, in such a storage system, at least one of the panels comprises an engagement notch adapted to contain the engagement protrusion formed in the resilient leg of the support component.

Preferably in that, at least one of the panels comprises at least one engagement slot adapted to engage with the protruding peg formed in the support component.

Preferably, the engagement notch and the engagement slot are colinear.

Preferably, each of the panels is adapted to hold a guide block on the side opposite the support component.

Preferably, the storage unit also comprises a projecting rib formed on the bottom surface of the storage unit such that the projecting rib is adapted to rest on the top of the support component attached to the panel.

The advantage of such a projecting rib is that it aids the drawer to rest comfortably on the support component irrespective of the size of the drawer. This allows the same type of support component to be used everywhere in the storage unit even when fitted with drawers of different sizes.

BRIEF DESCRIPTION OF THE DRAWINGS

Embodiments of the present invention will now be described by way of example only and with reference to the accompanying drawings, in which.

DETAILED DESCRIPTION OF EMBODIMENTS OF THE INVENTION

In the following specification, the terms front, back, rear, left, right, top, bottom, upper, lower and like terms will be used consistently with the arrangement shown in FIG. 1. In particular, the expression height corresponds to a dimension from top to bottom, width corresponds to a dimension from left to right and depth corresponds to a dimension from front to back. However, it is not limited to this orientation.

Figure 1:
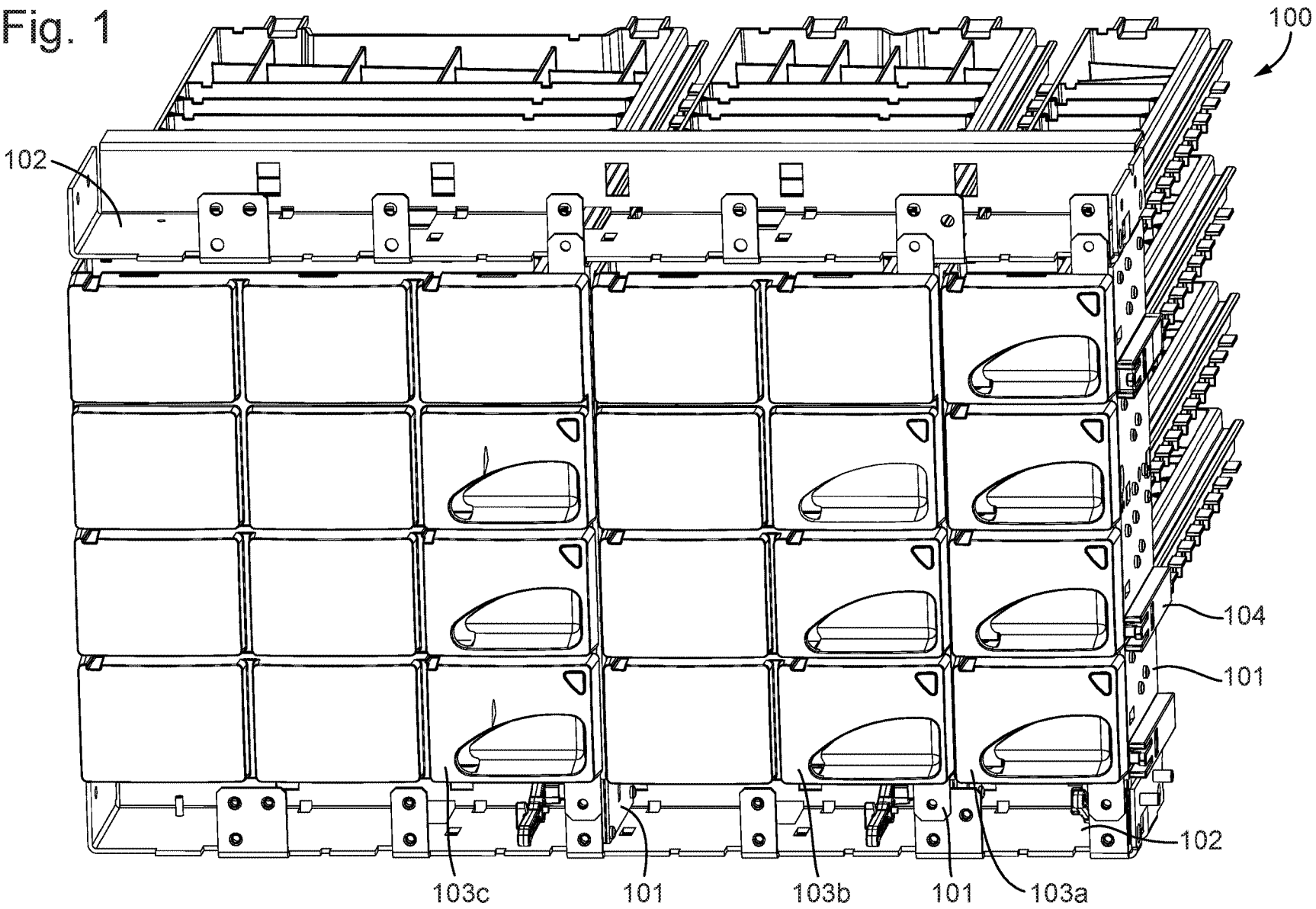
FIG. 1 is a perspective view of a storage system according to an aspect of the present invention.

FIG. 1 shows a section of a storage cabinet 100. The cabinet 100 comprises a plurality of panels 101 positioned vertically in the cabinet 100 and supported between two support beams 102 held horizontally in the cabinet 100. The panels 101 are mounted between desired points on the support beams 102. The cabinet 100 also includes drawers 103 held between adjacent panels 101 in a stacked arrangement. The cabinet 100 is configured to hold drawers of different sizes. As shown in the figure, on the rightmost side, the cabinet 100 includes a set of four drawers 103*a* of single width size. Next to that, the cabinet 100 has a set of three drawers 103*b* of double width size, and thereafter a set of three drawers 103*c* of triple width size. Also, the topmost drawers of the drawer set 103*b* and 103*c* are twice the height of all other drawers in the cabinet 100. The figure also shows an exposed side of the panel 101 with a series of supports 104 attached to the visible rightmost panel 101.

It is to be understood that this is only one of the several possible configurations of the drawers 103 in the storage cabinet 100. The cabinet 100 is capable of holding drawers of different sizes and it is modular in nature to allow re-configuration when needed. Moreover, although not shown in the figure, the cabinet 100 also comprises control electronics and cabling and a mechanical chassis and covers on three sides to restrict any unauthorised access to the cabinet 100.

Figure 2:
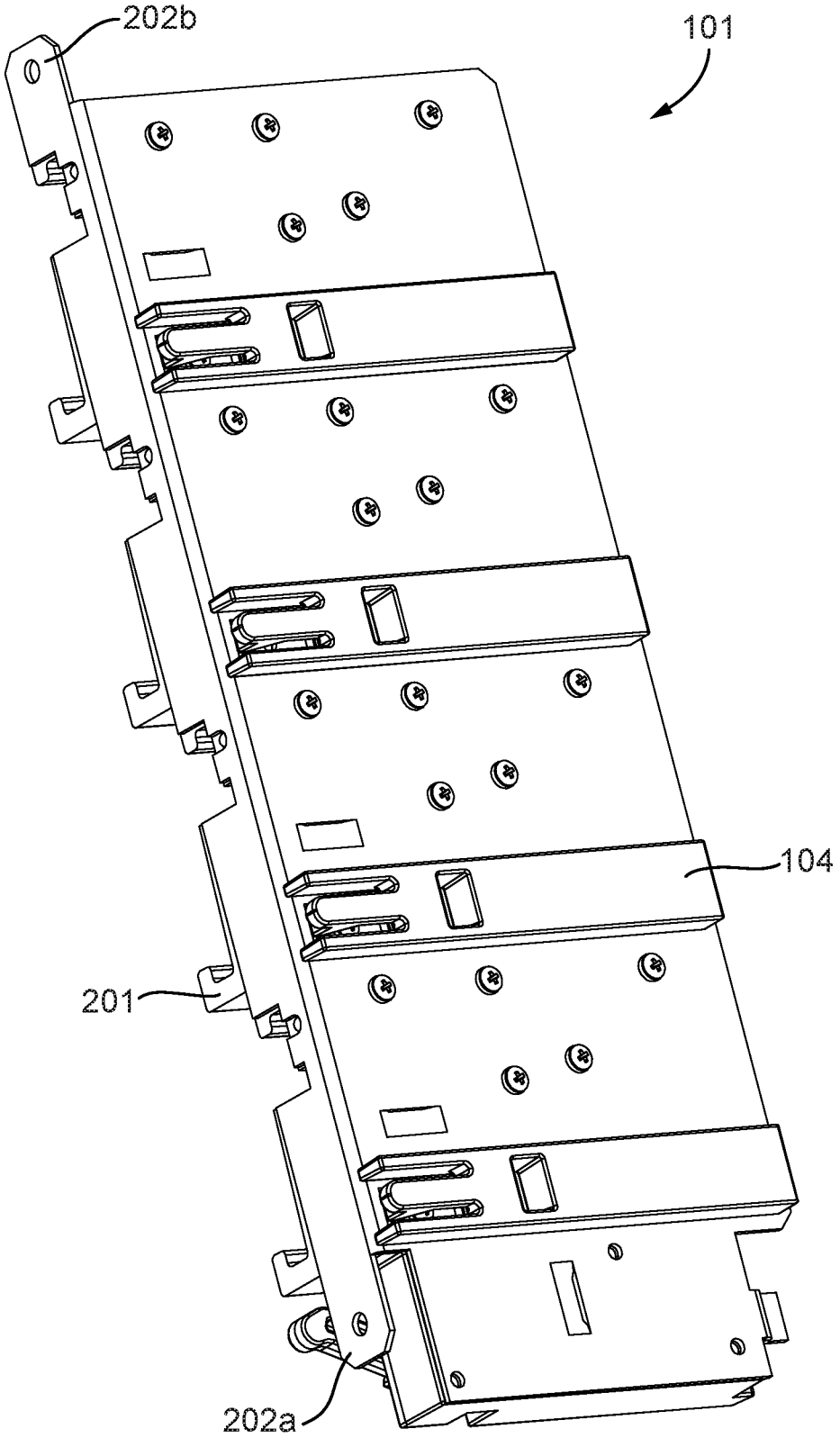
FIG. 2 is a perspective view of a panel in the storage system shown in FIG. 1.

FIG. 2 shows one side of the panel 101. In the present embodiment, the panel 101 comprises an upright, which is substantially L-shaped in cross-section and is formed by a front plate extending in the width direction and back plate extending in the depth direction. The top and bottom ends of the panel 101 have engagement extensions 202*a*, 202*b* to engage with the support beams 102.

The panel 101 is configured to hold guide blocks 201 for holding drawers in a stacked arrangement. As shown in the figure, each panel 101 can hold up to four drawers arranged above one another on four guide blocks 201. The panel 101 also includes corresponding supports 104 provided on the other side of the panel 101. A drawer is held between two adjacent panels 101 such that it is supported by the guide block 201 provided on the right-hand side panel 101 and the corresponding support 104 providing on the adjacent left-hand side panel 101 (as shown in FIG. 1).

The panel 101 also includes control means (corresponding the guide blocks 201) to monitor when the drawer is in its fully closed position, the distance the drawer moves, and the direction of movement of the drawer. Any suitable control means known in the art, such as a solenoid-activated latch mechanism and sensors, may be used in the cabinet 100.

It is to be noted that as the cabinet 100 is suitable for holding drawers 103 of different sizes, the guide blocks 201 and the supports 104 can be removed to accommodate drawers of different sizes. For example, the second guide block 201 and the corresponding support 104 on the adjacent panel 101 can be removed to make space for a double-height drawer. To allow this, the panel 101 has engagement features formed at multiple points on its surface to fix the guide blocks 201 and the supports 104 for holding/supporting drawers of different sizes on both sides of the panel 101.

Figure 3:
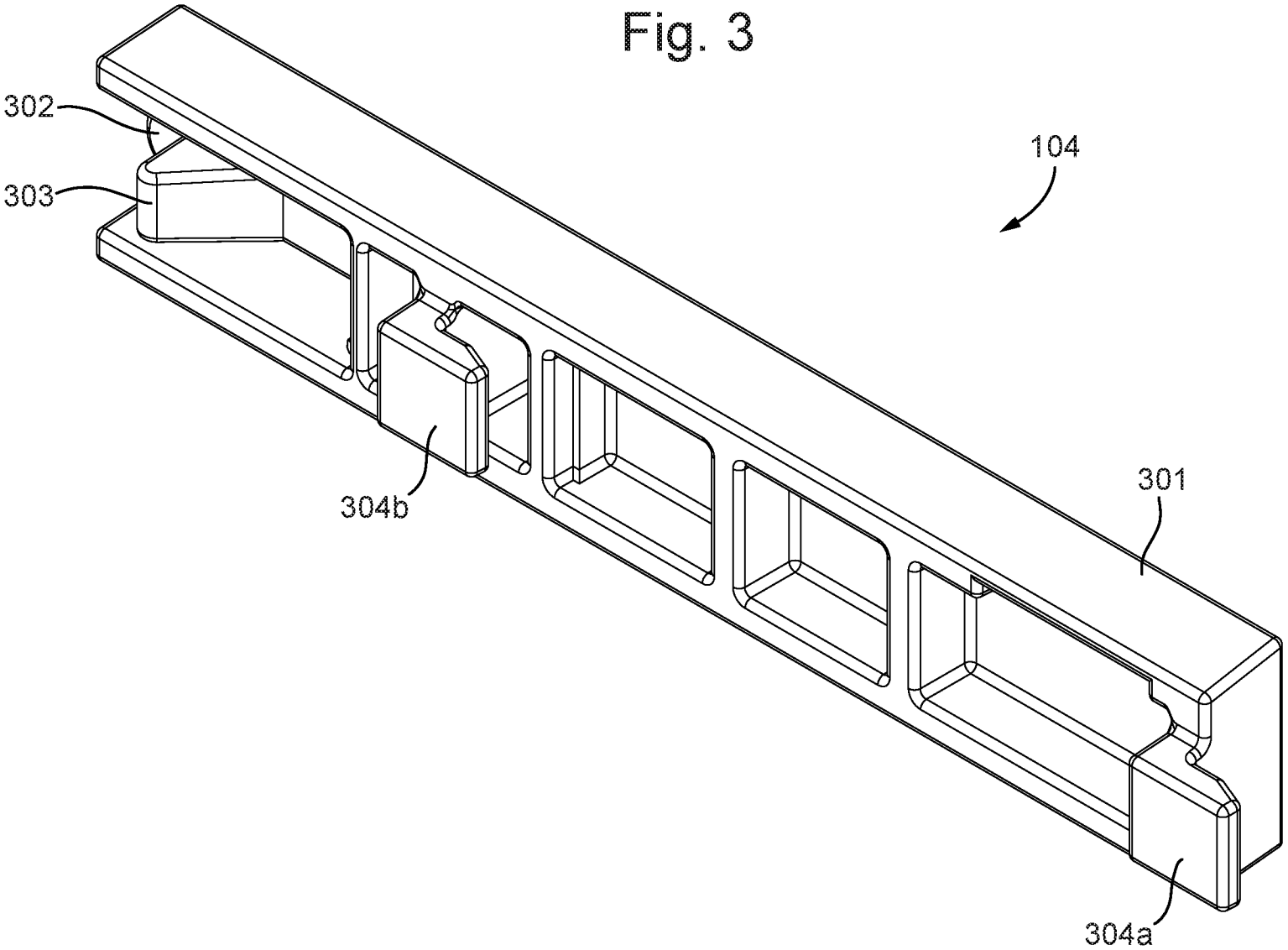
FIG. 3 is a perspective view of a support detached from the panel shown in FIG. 2.

FIG. 3 shows a rear perspective view of the support 104. In the present embodiment, the support 104 comprises an elongate bar 301 that extends along the depth of the panel 101. The support 104 is made of any suitable material and is formed as a unitary component. A resilient leg 302 is formed at one end in the upper surface of the bar 301 (more clearly shown in FIG. 4). The resilient leg 302 is defined in a cut-out portion formed between two parallel sides of the bar 301. The resilient leg 302 comprises an engagement protrusion 303 that extends downwards from the lower surface of the resilient leg 302. The engagement protrusion 303 has a flat surface on one side and a sloping surface on the other side.

The support 104 also comprises protruding pegs 304*a*, 304*b* formed in the lower surface of the bar 301. In the present embodiment, the protruding peg 304*a* is formed at an end opposite the end containing the resilient leg 302 and extends outwards from the bar 301. The protruding peg 304*b* is formed part-way along the length of the bar 301, adjacent the resilient leg 302. Both protruding pegs 304*a*, 304*b* have a flat lower surface and a partly sloped upper surface.

It is to be noted that the support 104 could have a resilient leg formed at each end of the bar 301 and not have the protruding pegs 304*a*, 304*b*. Alternatively, an engagement feature, similar to the resilient leg 302, could be formed in the middle of the bar 301. Moreover, the support 104 could be tapered such that it is thicker at one side and thinner at the other side.

Figure 4:
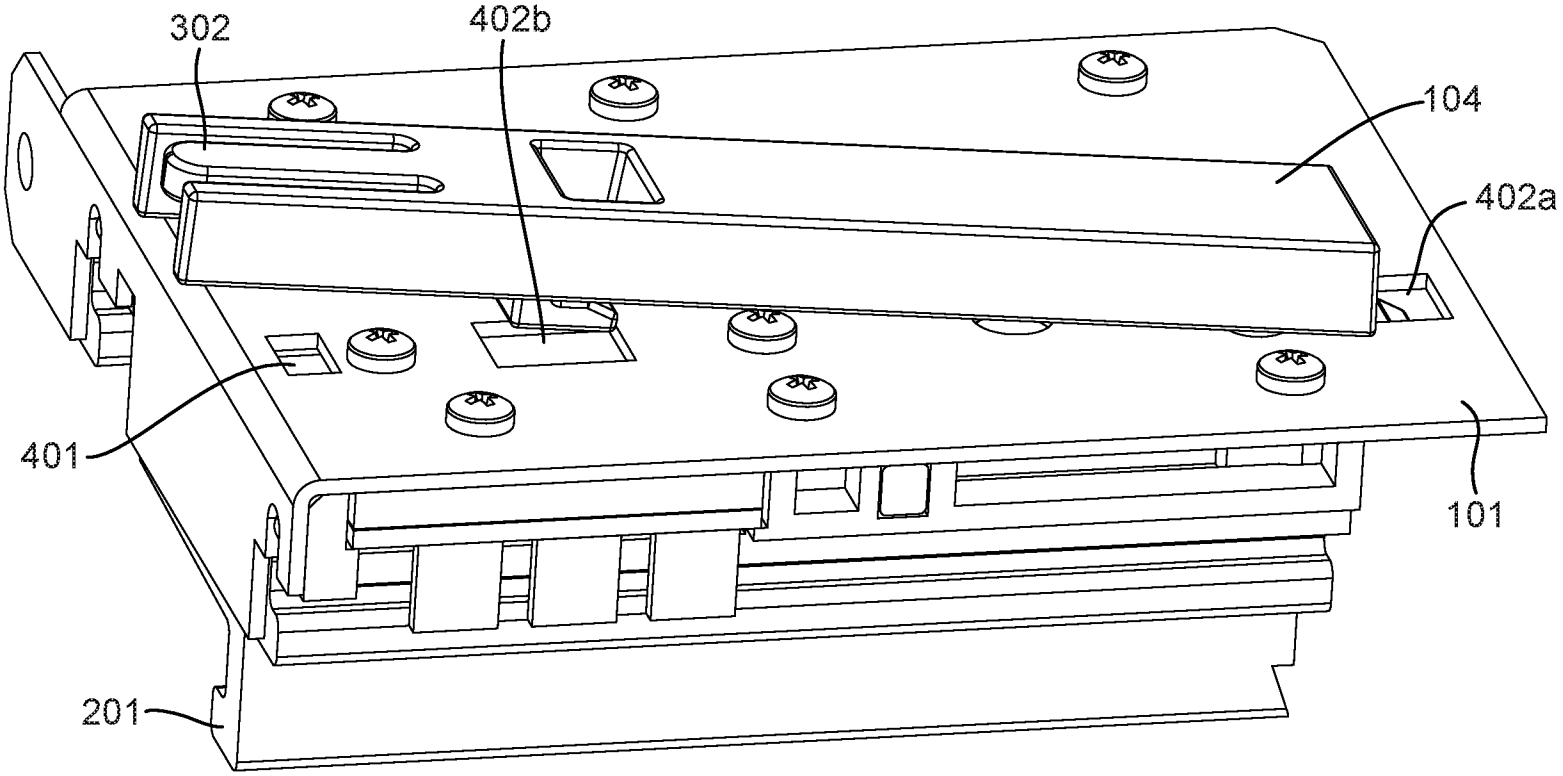
FIG. 4 is a perspective view of the support being attached to one side of the panel.

FIG. 4 shows the support 104 being attached to a side of the panel 101. In the present embodiment, the panel 101 comprises an engagement notch 401 formed near an edge of the panel 101. The engagement notch 401 is dimensioned such that it can contain the engagement protrusion 303 formed in the resilient leg 302 of the support 104. The panel 101 also includes engagement slots 402*a*, 402*b*. The engagement slot 402*a* is formed at the rear end of the panel 101 and the engagement slot 402*b* is formed part way along the length of the panel 101, adjacent the engagement notch 401. The engagement slots 402*a*, 402*b* are dimensioned such that they allow insertion of the protruding pegs 304*a*, 304*b* into them. The engagement notch 401 and the engagement slots 402*a*, 402*b* are colinear on the surface of the panel 101. It is to be understood that the number and position of the engagement notch 401 and the engagement slots 402*a*, 402*b* on the panel 101 may be altered.

To fix the support 104 to the panel 101, a user aligns the support 104 onto the side of the panel 101, as shown in the figure, and pushes the protruding pegs 304*a*, 304*b* into the engagement slots 402*a*, 402*b*. At this stage, the engagement protrusion 303 abuts the side of the panel 101 and the resilient leg 302 is elastically deformed. Once the protruding pegs 304*a*, 304*b* are contained in the engagement slots 402*a*, 402*b*, the user slides the bar 301 along the panel 101 until the engagement protrusion 303 formed in the resilient leg 302 clicks into place in the engagement notch 401 on the panel 101. Once engaged, it is securely held in place in 2 axes by the protruding pegs 304*a* and 304*b* and in the remaining axis by the engagement protrusion 303. Partly sloped surfaces of the protruding pegs 304*a*, 304*b* enable smooth sliding into the slots 402*a*, 402*b* and once engaged they are held in place. Moreover, the spacing between the pegs 304*a*, 304*b* and underside of the bar 301 is preferably less than or equal to the thickness of the panel 101 to enable a snug fit. Furthermore, due to the resistance offered by the flat back surfaces of the resilient leg 303 and the pegs 304, the bar 301 is rigidly held in the notch 401 and the slots 402 and does not slide outwards.

Figure 5:
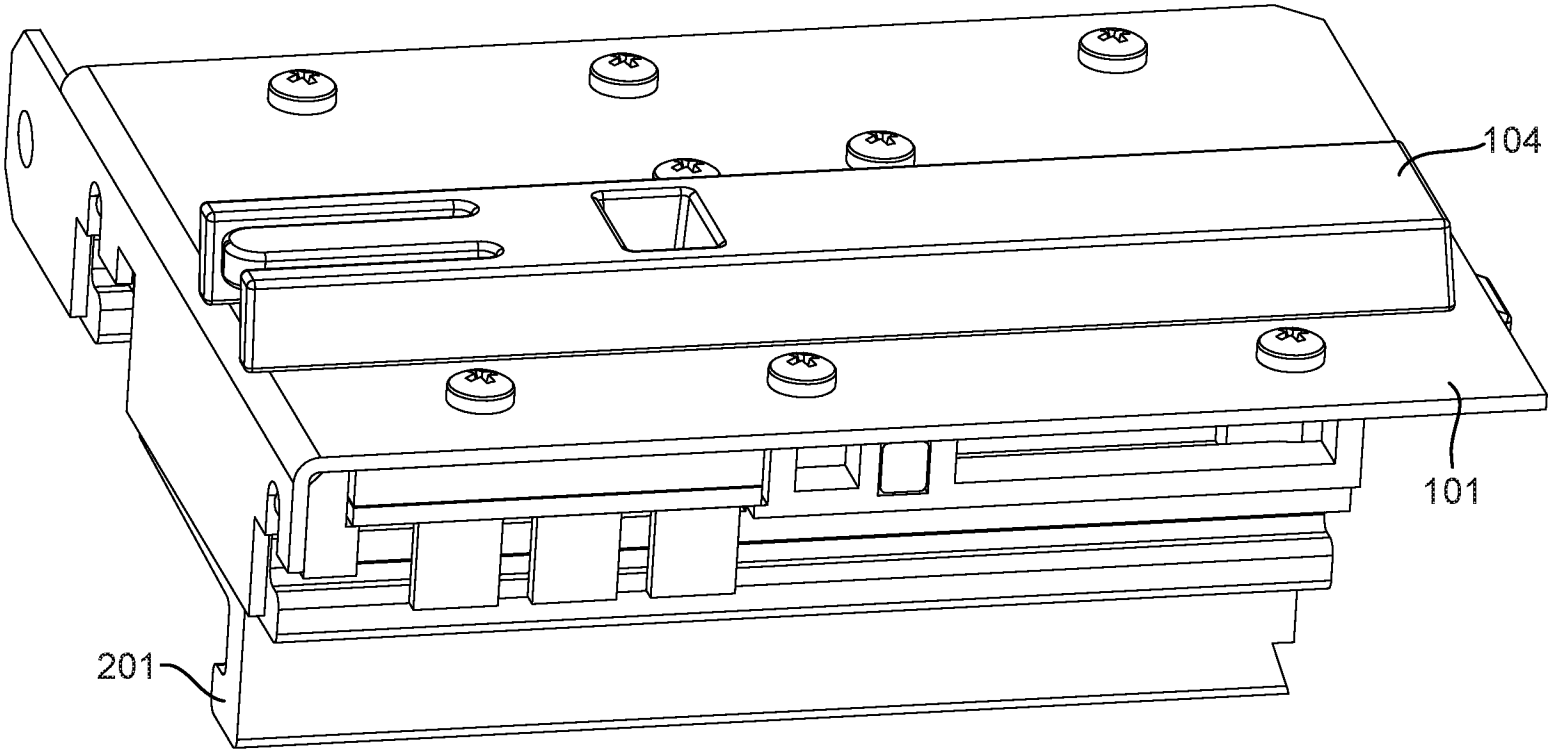
FIG. 5 is a perspective view of the support fully attached to one side of the panel.

FIG. 5 shows the support 104 attached to the panel 101. When fixed, the support 104 extends along the length of the panel 101 and is rigidly held in place by the engagement protrusion 303 and the protruding pegs 304. The flat surface of the engagement protrusion 303 in the direction of the force prevents sliding of the engagement protrusion 303 from the engagement notch 401.

When it is needed to re-configure the cabinet 100, the support 104 can be easily removed from the panel 101. To disengage the engagement protrusion 303 from the engagement notch 401, the user exerts a force on the resilient leg 302 perpendicular to the panel 101. Once it is disengaged, the user simply slides the bar 301 towards the front of the panel 101 and pulls out the protruding pegs 304*a*, 304*b* from the respective slots 402*a*, 402*b*. The removed support 101 can then be fixed elsewhere on any panel 101 in the cabinet 100 as required.

Figure 6A:
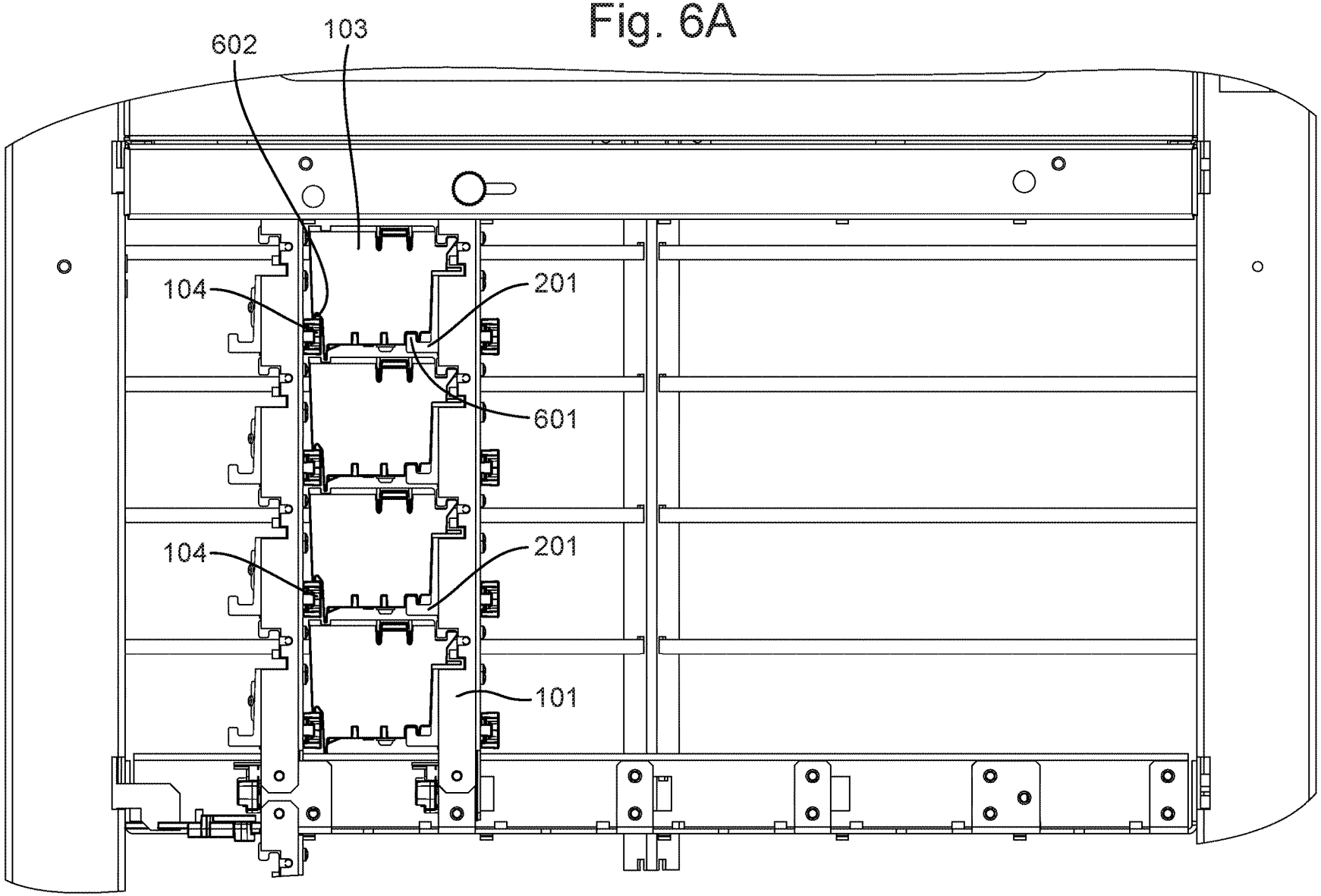
FIG. 6A is a front view of four standard-sized drawers supported on respective supports.

A drawer is held over the support 104 attached to the panel 101 on the left-hand side and the guide block 201 attached to the adjacent panel 101 on the right-hand side. As shown in FIG. 6A, the lower right side of the drawer 103 has an engagement rail 601 which engages with a corresponding rail formed on the guide block 201, and the lower left side of the drawer 103 has a projecting rib 602 which allows the drawer to be supported on the support 104. In the drawer 103, the projecting rib 602 is formed as an extension along the left-hand side wall of the drawer. In a large drawer (double-height or triple-height), the distance between the projecting rib 602 on the drawer 103 and the support 104 is greater than that in a standard drawer (single-height). Therefore, the large drawer may not be well-supported by the support 104.

Figure 6B:
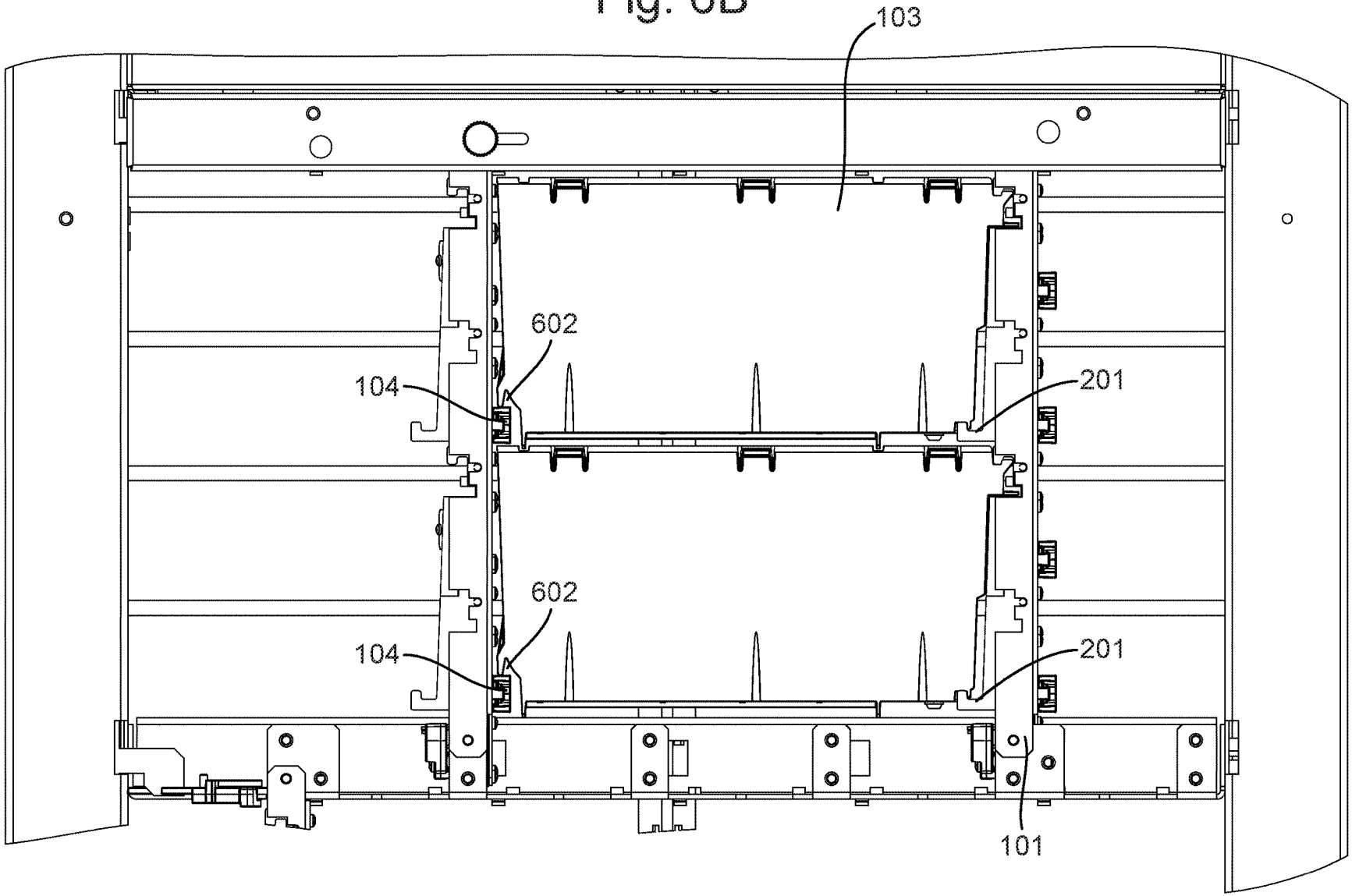
FIG. 6B is a front view of two large-sized drawers supported on respective supports.

To address this issue, the projecting rib 602 in the large drawer is moved slightly further to the left as shown in FIG. 6B. By moving the projecting rib 602 to the left, the distance between the rib 602 and the support 104 is reduced and the drawer 103 can be sufficiently supported on the support 104. This allows all types of drawers to be supported on the same support 104 without having to install different sized supports 104. It is to be understood that larger guide blocks 201 would still be needed to accommodate larger drawers. As shown in FIG. 6A, the right-hand side panel 101 is set up for holding four single-height drawers 103 on its left-hand side and is fitted with four standard sized guide blocks 201 on its left-hand side. However, as shown in FIG. 6B, the right-hand side panel 101 is set up for holding two double-height drawers 103 and is fitted with two large guide blocks 201 on its left-hand side. But in both FIGS. 6A and 6B, the panels 101 are fitted with identical supports 104.

The support 104 of the present invention offers significant advantages in terms of costs and convenience. First and foremost, as the support 104 is a simple unitary component with self-contained engagement features to attach it to the panel 101, it is easy to install during initial assembly or re-configuration of the cabinet 100. There is no need for screws or any other fastening means to secure it to the panel 101, thus saving costs and assembly time. Moreover, as the support 104 is provided with the resilient leg 302, it is easily to remove it from the panel 101 when needed and fix it elsewhere on any panel 101 in the cabinet 100. Furthermore, with slight modification in the drawers 103, the same support 104 can be used for any drawer size in the cabinet 100. There is no need to stock supports of different sizes and it is easy to re-configure the cabinet 100 with different sized drawers without having to change the supports 104. Therefore, the support 104 reduces costs further by eliminating the need for additional components such as screws needed in assembling the cabinet 100.

Those skilled in the art will recognise that the support 104 of the present invention has a wide variety of different applications, from storage cabinets to other units in which something is to be supported between two panels. For example, such supports 104 can be used in simple shelves where flat storage slabs could be supported on two supports 104 provided on either side.

The foregoing description has been given by way of example only and it will be appreciated by a person skilled in the art that modifications can be made without departing from the scope of the present invention.

The position of the resilient leg 302 can be changed in the support 104 or it can be formed with different shape and size. For example, the resilient leg 302 can be formed in the mid cut-out section defined in the support 104. Moreover, the protruding pegs 304 are optional and instead two resilient legs 302 can be formed at either end in the support 104. Alternatively, the protruding pegs 304 could be formed at either end in the support 104 with the resilient leg 302 being formed in the mid-section as in the example above. Furthermore, the support 104 may be formed of varying thickness such that it can be fixed to the panel 101 either with the thin side up to support standard drawers or with the thick side up to support large drawers.

The foregoing description of illustrated embodiments of the present invention, including what is described in the abstract, is not intended to be exhaustive or to limit the invention to the precise forms disclosed herein. While specific embodiments of the invention are described herein for illustrative purposes only, various equivalent modifications are possible within the scope of the present invention, as those skilled in the relevant art will recognise and appreciate. As indicated, these modifications may be made to the present invention in light of the foregoing description of illustrated embodiments of the present invention and are to be included within the scope of the present invention.

The invention claimed is:

1. A support component comprising:

an elongate bar;

a resilient leg formed in an upper surface at one end of the elongate bar and extending between two opposite sides of the elongate bar, wherein the resilient leg comprises an engagement protrusion; and at least one protruding peg extending outwards from a lower surface of the elongate bar and protecting away from the resilient leg, wherein the engagement protrusion has (i) a flat surface on a side of the engagement protrusion that is further from the at least one protruding peg and (ii) a sloping surface on a side of the engagement protrusion that is closer to the at least one protruding peg.

2. The support component according to claim 1, wherein the protruding peg is formed at the other end of the elongate bar.

3. The support component according to claim 1, wherein the protruding peg is formed part way along a length of the elongate bar and adjacent the resilient leg.

4. A storage cabinet comprising:

at least one storage unit adapted to be held between panels mounted onto support beams; and the support component according to claim 1, wherein the support component is adapted to be fixed to a side of at least one of the panels such that the storage unit is at least partially supported on the support component.

5. The storage cabinet according to claim 4, wherein at least one of the panels comprises an engagement notch adapted to contain the engagement protrusion formed in the resilient leg of the support component.

6. The storage cabinet according to claim 5, wherein at least one of the panels comprises at least one engagement slot adapted to engage with the protruding peg formed in the support component.

7. The storage cabinet according to claim 6, wherein the engagement notch and the engagement slot are colinear.

8. The storage cabinet according to claim 4, wherein each of the panels is adapted to hold a guide block on a side opposite the support component.

9. A storage system according to claim 4, wherein the storage unit comprises a projecting rib formed on a bottom surface of the storage unit such that the projecting rib is adapted to rest on a top of the support component attached to the panel.

* * * * *